US011733728B2

(12) United States Patent
Chang et al.

(10) Patent No.: US 11,733,728 B2
(45) Date of Patent: Aug. 22, 2023

(54) SPEED REGULATING HAND BRAKE MECHANISM AND METHOD FOR SPEED REGULATION OF SAME

(71) Applicant: Beijing WeMed Medical Equipment Co., Ltd., Beijing (CN)

(72) Inventors: Kaihua Chang, Beijing (CN); Chengwen Hu, Beijing (CN)

(73) Assignee: BEIJING WEMED MEDICAL EQUIPMENT CO., LTD., Beijing (CN)

( * ) Notice: Subject to any disclaimer, the term of this patent is extended or adjusted under 35 U.S.C. 154(b) by 0 days.

(21) Appl. No.: 17/560,032

(22) Filed: Dec. 22, 2021

(65) Prior Publication Data

US 2022/0113755 A1 Apr. 14, 2022

Related U.S. Application Data

(63) Continuation of application No. PCT/CN2021/078563, filed on Mar. 2, 2021.

(30) Foreign Application Priority Data

Aug. 18, 2020 (CN) ..... 202010832729.0

(51) Int. Cl.
*G05G 13/00* (2006.01)
*G05G 1/01* (2008.04)
(Continued)

(52) U.S. Cl.
CPC ..... *G05G 13/00* (2013.01); *G05G 1/01* (2013.01); *G05G 1/02* (2013.01); *G05G 5/05* (2013.01);
(Continued)

(58) Field of Classification Search
CPC .. G05G 1/01; G05G 1/02; G05G 5/05; G05G 2505/00; G05G 13/00; G05G 2009/04774;
(Continued)

(56) References Cited

U.S. PATENT DOCUMENTS 3,328,613 A * 6/1967 Gawron ..... H01H 9/061 318/507
3,721,879 A * 3/1973 Corey ..... H01H 9/061 388/919
(Continued)

FOREIGN PATENT DOCUMENTS

JP 2012234278 A * 11/2012
WO WO-2013048776 A1 * 4/2013 ..... H01C 10/50

*Primary Examiner* — Daniel D Yabut
(74) *Attorney, Agent, or Firm* — Daniel M. Cohn; Howard M. Cohn

(57) ABSTRACT

A speed regulating hand brake mechanism and method for speed regulation of the speed regulating hand brake mechanism is disclosed. The mechanism includes: a housing, wherein an installation cavity is defined inside the housing; a speed regulating button is hinged to the side wall of the housing; an installation cavity is internally provided with the driving part hinged to the speed regulating button; the rack is hinged to the driving part and can slide along the inner wall of the installation cavity in a horizontal direction after receiving the pressing force transmitted from the speed regulating button; the encoder is fixed on a first fixing plate in the installation cavity, the rack drives a gear arranged at the top of the encoder to rotate, and changes the code value output by the encoder; the elastic end of the return piece is located inside the speed regulating button.

8 Claims, 4 Drawing Sheets

(51) Int. Cl.
*G05G 1/02* (2006.01)
*G05G 5/05* (2006.01)
*H01H 13/14* (2006.01)

(52) U.S. Cl.
CPC ..... *H01H 13/14* (2013.01); *G05G 2505/00* (2013.01)

(58) Field of Classification Search
CPC ..... H01H 13/186; H01H 3/40; H01H 3/46; H01H 9/061
See application file for complete search history.

(56) References Cited

U.S. PATENT DOCUMENTS

| | | | | |
|---|---|---|---|---|
| 3,852,554 | A * | 12/1974 | Heide | H01H 13/58 74/435 |
| 4,660,019 | A * | 4/1987 | Bauer | H01H 9/061 200/522 |
| 6,550,161 | B2 * | 4/2003 | Hanafusa | E01H 5/04 37/246 |
| 2014/0007732 | A1 * | 1/2014 | Ogawa | A61B 34/74 74/491 |
| 2014/0345416 | A1 * | 11/2014 | Kaskawitz | A01D 34/6812 74/490.14 |
| 2016/0304180 | A1 * | 10/2016 | Steven | G05G 1/58 |

* cited by examiner

SPEED REGULATING HAND BRAKE MECHANISM AND METHOD FOR SPEED REGULATION OF SAME

This patent application is a continuation application of PCT/CN2021/078563 filed on Mar. 2, 2021, which further claims the benefit and priority of Chinese Patent Application No. of CN 202010832729.0 filed on Aug. 18, 2020, the disclosure of which is incorporated by reference herein in its entirety as part of the present application.

TECHNICAL FIELD

The present disclosure relates to the technical field of medical instruments, and more specifically, to a speed-regulating hand brake mechanism and method for speed regulation of the hand brake mechanism.

BACKGROUND ART

Medical angiography X-ray machine is one of the most commonly used interventional equipments in hospital, which is usually used in the interventional operation and treatment of heart, brain, liver, kidney, lung and so on. In the interventional surgery or treatment process, doctors need to move the equipment to multiple positions in order to observe the imaging situation of patients' blood vessels in an all-round way and accurately find the position of the lesion, the movement speed of the equipment needed in different positions is also different at different positions. Therefore, it is necessary to design a device that can adjust the speed on the functional structure that requires different movement speeds.

However, the current speed regulation mode of the interventional device is basically realized by adopting a software program setting mode, the speed of the equipment in a certain position is set in advance, and the equipment runs according to the set speed. In this way, the speed is relatively fixed, and according to different patient conditions, if the doctor wants the speed of the device to run or the slow point at a certain position, the speed (in accordance with a pre-designed program) cannot be changed at any time, and thus the method cannot meet the use requirements of the doctor.

Therefore, how to provide a speed regulating hand brake mechanism is an urgent problem to be solved by those skilled in the art.

SUMMARY

Therefore, an object of the present disclosure is to provide a speed regulating hand brake mechanism to solve the problem that the speed of the existing interventional equipment cannot be changed at any time according to the requirements of use.

The present disclosure provides a speed regulating hand brake mechanism, including:

a housing, wherein an installation cavity is defined inside the housing;

a speed regulating button, wherein the speed regulating button is hinged to the side wall of the housing;

a driving part, wherein an installation cavity is internally provided with the driving part hinged to the speed regulating button;

a rack, wherein the rack is hinged to the driving part and can slide along the inner wall of the installation cavity in a horizontal direction after receiving the pressing force transmitted from the speed regulating button;

an encoder, wherein the encoder is fixed on a first fixing plate in the installation cavity, the rack drives a gear arranged at the top of the encoder to rotate, and a code value output by the encoder is changed;

a return piece, wherein the elastic end of the return piece is located inside the speed regulating button, and the other side of the return piece is fixed on the inner wall of the installation cavity and is used for resetting the speed regulating button.

As can be seen from the above technical solution, compared with the prior art, the present disclosure discloses a speed regulating hand brake mechanism, wherein the drive part is pushed by the speed regulating button, and then the rack is pushed to drive the top gear of the encoder to rotate to change the encoder code value, and the external control system controls the external servo motor driver to rotate at different speeds according to different code values of the encoder, so that the speed regulation is realized on a functional structure requiring different moving speeds, and the use requirements of doctors in interventional surgery or treatment are met.

Further, the housing includes a first housing and a second housing which are mutually buckled in a vertical direction; thereby facilitate removal and installation of that internal components.

Further, the driving part includes a fixing base, a connecting rod and a connecting base; the fixing base is fixed to the top of the inner side of the speed regulating button, and the connecting base is integrally connected to one end of the rack; two ends of the connecting rod are provided with hinge shafts in different directions, and the two ends of the connecting rod are respectively hinged to a hinge hole I on the fixing base and a hinge hole II on the connecting base; thereby ensure that in that pushing or return process of the speed regulating button, the connecting rod respectively rotate around the hinge shaft in the hinge holes in the fixed seat and the connecting seat and flexibly rotates without being locked.

Further, a linear guide rail is fixed on the inner wall of the installation cavity corresponding to the position of the gear; the rack can slide on the linear guide rail through a fixed integral sliding block; thereby ensure that the rack can only move along the linear guide rail and ensuring that the speed regulate button is pushed and pressed so as to change the code value of the encoder.

Further, an inner bottom of the speed regulating button is hinged to the housing to provide a bottom fulcrum for the speed regulating button.

Further, one end of the return piece is an elastic end and the other end is an installation fixed end, the installation fixing end is provided with an installation hole, and the installation hole is fixed with the inner wall of the installation cavity by a screw; the elastic end is bent downward along the installation fixing end and elastically contacts with the inner bottom of the speed regulating button; conveniently speed regulating button return.

Further, the speed regulating hand brake mechanism also includes an exposure key, wherein the exposure key includes: an exposure button box, a key switch and a return spring; the exposure button box is partially inserted into the through hole provided at the top of the housing, and its bottom is fixed in the installation cavity by the second fixing plate; the inside of the exposure button box is provided with the key switch, and the wire of the key switch extends downward to join the wire of the encoder and protrudes from the bottom of the installation cavity; the return spring is sleeved on the key switch. Therefore, the exposure key and the speed regulating handbrake are integrated together to be placed outdoors, so that the space is saved, and the operation is convenient; the operation speed of the equipment from the outside of the operating room can be conveniently observed by the doctor, and the radiation damage of the X-ray to the doctor is reduced.

Further, the bottom of the housing is connected with a base for fixing. The base is placed outside the operating room and the hand brake is placed on the computer table.

According to another aspect of the disclosure, a method for regulating the speed of the speed regulating hand brake is provided, including: pushing the driving part by the speed regulating button, then pushing the rack to drive a top gear of the encoder to rotate to change a code value of the encoder, and controlling an external servo motor driver to rotate at different speeds according to different code values of the encoder to realize speed regulation by an external control system. Therefore, the speed regulation is realized on the functional structure requiring different movement speeds, and the use requirements of doctors in interventional surgery or treatment are met.

BRIEF DESCRIPTION OF THE DRAWINGS

In order to more clearly explain the embodiments of the present disclosure or the technical scheme in the prior art, the follow is a brief description of the drawings required to be used in the description of the embodiment or the prior art, and it is obvious that the drawings in the following description are only embodiments of the present disclosure, and for those skilled in the art, other drawings can be obtained on the basis of the provided drawings without any creative effort.

In the drawings.

Figure 1:
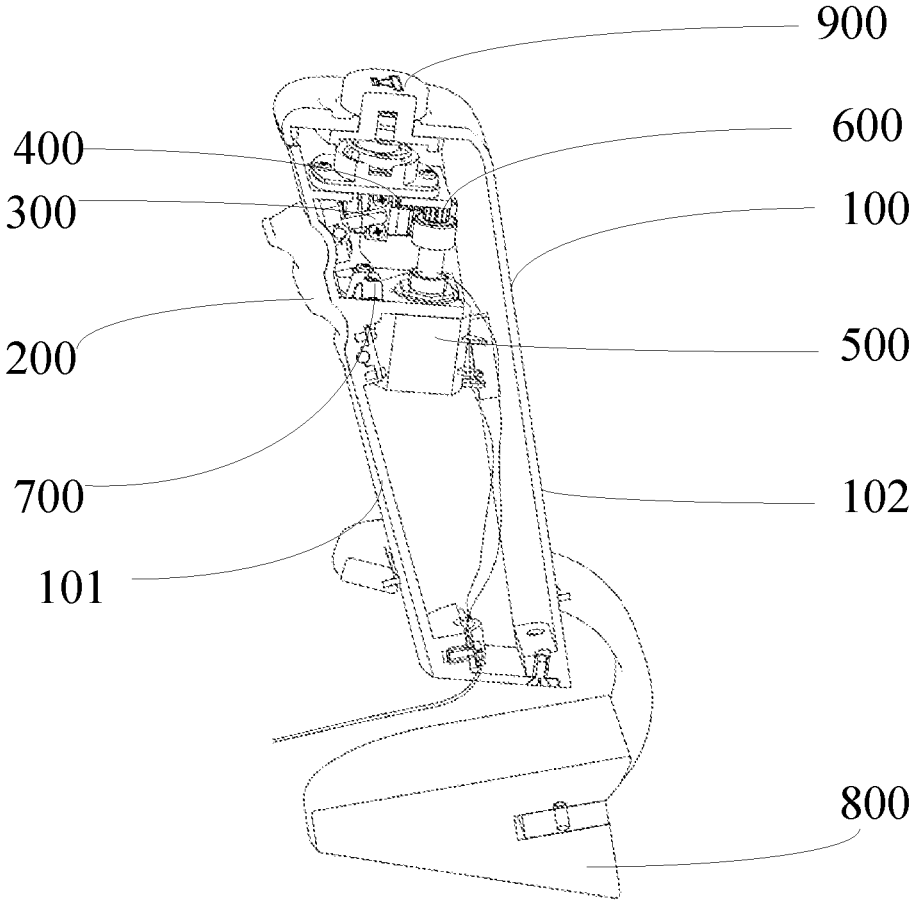
FIG. 1 is a schematic structural diagram of a speed regulating hand brake mechanism provided by the present disclosure.

100—the housing, 101—the first housing, 102—the second housing, 103—the linear guide rail, 104—the first fixing plate, 105—the second fixing plate, 200—the speed regulating button, 300—the driving part, 301—the fixing base, 302—the connecting rod, 303—the connecting base, 400—the rack, 500—the encoder, 600—the gear, 700—the return piece, 701—the elastic end, 702—the installation fixed end, 800—the base, 900—the exposure key, 901—the exposure button box, 902—the key switch, 903—the return spring.

DETAILED DESCRIPTION OF THE EMBODIMENTS

In the following, embodiments of the present disclosure will be described in detail, examples of which are shown in the drawings, in which the same or similar reference numerals indicate the same or similar elements or elements with the same or similar functions. The embodiments described below with reference to the drawings are exemplary and are intended to explain the present disclosure, but are not to be construed as limitations of the present disclosure.

In the description of the present disclosure, it is to be understood that the terms "upper", "lower", "front", "rear", "left", "right", "vertical", "horizontal", "top", "bottom", "inner", "outer", and the like indicate an orientation or positional relationship based on that shown in the drawings, merely for convenience of description and simplicity of description, and do not indicate or imply that the indicated devices or elements must have a particular orientation, be constructed and operate in a particular orientation, and are therefore not to be construed as limiting the disclosure.

In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of the features. In the description of the present disclosure, "plural" means two or more, unless otherwise specifically defined.

In the present disclosure, unless otherwise specified and limited, the terms "installation", "connection", "connection" and "fixation" should be broadly understood, for example, they can be fixed connection, detachable connection or integrated; Can be mechanically connected or electrically connected; It can be directly connected or indirectly connected through an intermediate medium, and it can be the internal communication of two elements or the interaction between two elements. For ordinary technicians in the field, the specific meanings of the above terms in the present disclosure can be understood according to specific situations.

In the present disclosure, unless otherwise specified and limited, the first feature "above" or "below" the second feature may include the direct contact between the first and second features, or the contact between the first and second features instead of direct contact but through another feature between them. Furthermore, the first feature "above", "above" and "above" of the second feature includes that the first feature is directly above and obliquely above the second feature, or simply indicates that the horizontal height of the first feature is higher than that of the second feature. The first feature "below", "below" and "below" of the second feature includes that the first feature is directly below and obliquely below the second feature, or simply indicates that the horizontal height of the first feature is smaller than that of the second feature.

Figure 2:
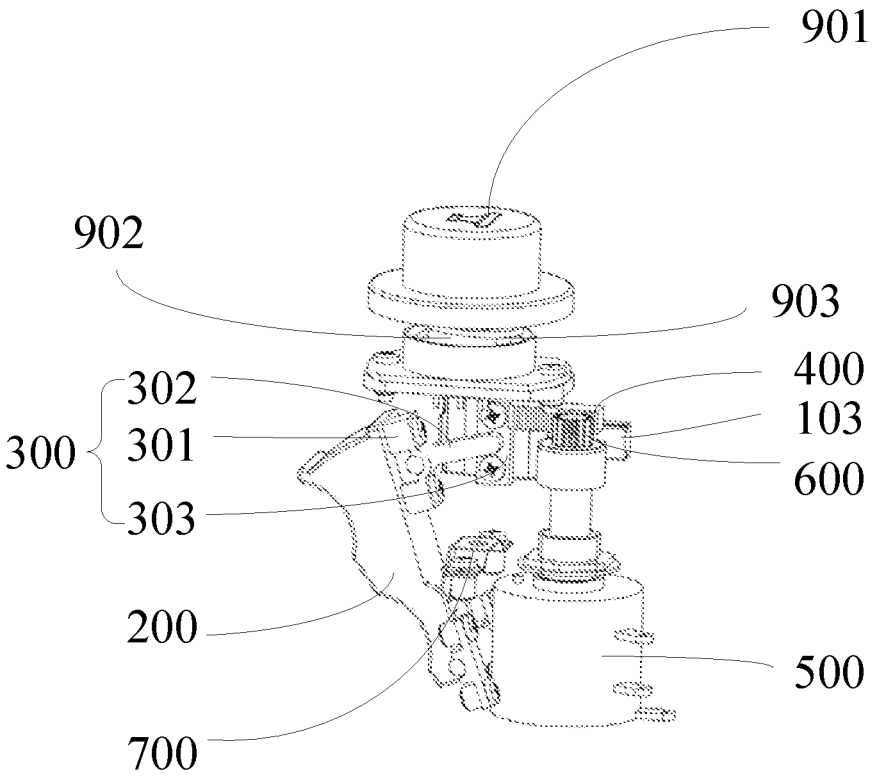
FIG. 2 is a schematic structural diagram of a speed regulating hand brake mechanism provided by the present disclosure (the housing is not shown)

Referring to FIGS. 1-2, the embodiment of the disclosure discloses a speed-regulating hand brake mechanism, including:

a housing 100, wherein an installation cavity is defined inside the housing (100);

a speed regulating button 200, wherein the speed regulating button 200 is hinged to the side wall of the housing 100;

a driving part 300, wherein an installation cavity is internally provided with the driving part 300 hinged to the speed regulating button 200;

a rack 400, wherein the rack 400 is hinged to the driving part 300 and can slide along the inner wall of the installation cavity in a horizontal direction after receiving the pressing force transmitted from the speed regulating button 200;

an encoder 500, wherein the encoder 500 is fixed on a first fixing plate 104 in the installation cavity, the rack 400 drives a gear 600 arranged at the top of the encoder 500 to rotate, and a code value output by the encoder 500 is changed;

a return piece 700, wherein the elastic end of the return piece 700 is located inside the speed regulating button (200), and the other side of the return piece 700 is fixed on the inner wall of the installation cavity and is used for resetting the speed regulating button 200.

The disclosure discloses a method for regulating the speed of the speed regulating hand brake, and the method includes: pushing the driving part by the speed regulating button, then pushing the rack to drive a top gear of the encoder to rotate to change a code value of the encoder, and controlling an external servo motor driver to rotate at different speeds according to different code values of the encoder to realize speed regulation by an external control system. Therefore, the speed regulation is realized on the functional structure requiring different movement speeds, and the use requirements of doctors in interventional surgery or treatment are met.

Advantageously, the housing 100 includes a first housing 101 and a second housing 102 which are mutually buckled in a vertical direction. Thereby facilitating the removal and installation of the internal components.

Figure 3:
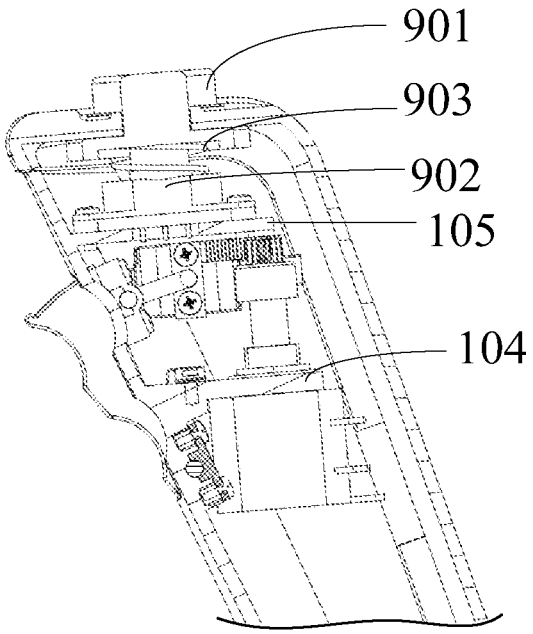
FIG. 3 is a partial sectional view of a speed regulating hand brake mechanism provided by the present disclosure.
Figure 4:
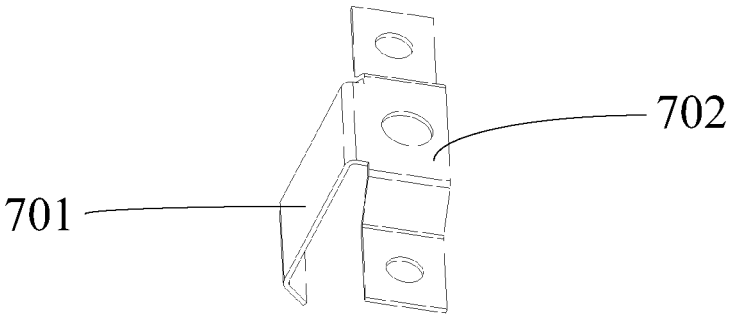
FIG. 4 is a schematic diagram showing the structure of the return piece.
Figure 5:
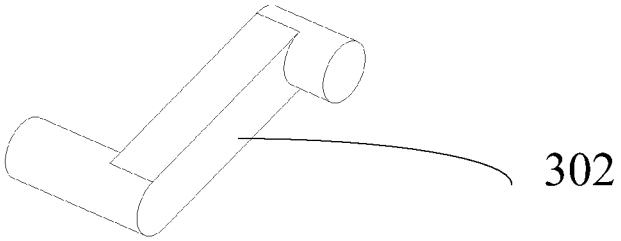
FIG. 5 is a schematic diagram showing the structure of the connecting rod.
Figure 6:
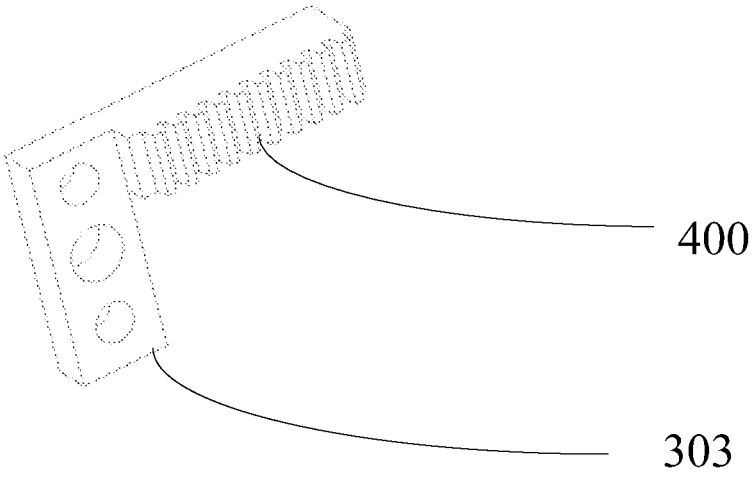
FIG. 6 is a schematic view showing the structure of the connecting base and the rack.

Referring to FIG. 3, the driving part 300 includes a fixing base 301, a connecting rod 302 and a connecting base 303; the fixing base 301 is fixed to the top of the inner side of the speed regulating button 200, and the connecting base 303 is integrally connected to one end of the rack 400; two ends of the connecting rod 302 are provided with hinge shafts in different directions; the two ends of the connecting rod are respectively hinged to a hinge hole I on the fixing base 301 and a hinge hole II on the connecting base 303. Thereby ensuring that in the pushing or return process of the speed regulating button, the connecting rod respectively rotate around the hinge shaft in the hinge holes in the fixed seat and the connecting seat and flexibly rotates without being locked.

Advantageously, a linear guide rail 103 is fixed on the inner wall of the installation cavity corresponding to the position of the gear 600; the rack 400 can slide on the linear guide rail 103 through a fixed integral sliding block. Thereby ensuring that the rack can only move along the linear guide rail and ensuring that the speed regulate button is pushed and pressed so as to change the code value of the encoder.

Advantageously, an inner bottom of the speed regulating button is hinged to the housing to provide a bottom fulcrum for the speed regulating button.

Advantageously, one end of the return piece 700 is an elastic end 701 and the other end is an installation fixed end 702, the installation fixing end 702 is provided with an installation hole, and the installation hole is fixed with the inner wall of the installation cavity by a screw; the elastic end 701 is bent downward along the installation fixing end 702 and elastically contacts with the inner bottom of the speed regulating button 200 to facilitate the return of the speed control button.

In another embodiment of the present disclosure, the speed regulating hand brake mechanism further includes an exposure key 900, wherein the exposure key 900 includes: an exposure button box 901, a key switch 902 and a return spring 903; the exposure button box 901 is partially inserted into the through hole provided at the top of the housing 100, and its bottom is fixed in the installation cavity by the second fixing plate 105; the inside of the exposure button box is provided with the key switch 902, and the wire of the key switch 902 extends downward to join the wire of the encoder 500 and protrudes from the bottom of the installation cavity; the return spring 903 is sleeved on the key switch 902. Therefore, the exposure key and the speed regulating hand-brake are integrated together to be placed outdoors, so that the space is saved, and the operation is convenient; the operation speed of the equipment from the outside of the operating room can be conveniently observed by the doctor, and the radiation damage of the X-ray to the doctor is reduced.

When the exposure function is required, the top of the exposure button box is pressed by hand, and the button transmit force to the key switch to force the key switch, so that the key switch is triggered to send a signal to an external control system to realize exposure. After releasing, the button returns to the original position under the action of the return spring.

Advantageously, the bottom of the housing 100 is connected with a base 800 for fixing, the base is placed outside the operating room and the hand brake is placed on the computer table.

In present disclosure, when the movement speed of the equipment needs to be regulated, pressing the speed regulating button by hand, the speed regulating button rotates around a hinge shaft, and the speed regulating button drives a connecting rod to move to the right and a rack to slide to the right on the linear guide rail, as the rack is engaged with the gear, the gear moves in the clockwise direction, thereby driving the encoder to move in the clockwise direction, and the code value of the encoder will become larger and larger, and the encoder outputs the code value to an external control system, thereby controlling the moving speed of the device to be larger and larger. At this time, as the force of the speed regulating button causes the return piece to deform, after the speed regulating button is released, the return piece applies force to the speed regulating button to restore the speed regulating button to the original position, the speed regulating button drives the connecting rod to move leftward, and the connecting rod drives the rack to slide leftward, as the rack is meshed with the gear, the gear moves in a counterclockwise direction to drive the encoder to move in a counterclockwise direction, and then the code value of the encoder is smaller and smaller, and the encoder outputs the code value to an external control system, so that the moving speed of the control device is smaller and smaller. Thereby realizing the function of regulating the moving speed of the equipment.

The disclosure also provides a method for regulating the speed of the speed regulating hand brake, and the method includes: pushing the driving part by the speed regulating button, then pushing the rack to drive a top gear of the encoder to rotate to change a code value of the encoder, and controlling an external servo motor driver to rotate at different speeds according to different code values of the encoder to realize speed regulation by an external control system. Therefore, the speed regulation is realized on the functional structure requiring different movement speeds, and the use requirements of doctors in interventional surgery or treatment are met.

In the description of this specification, referring to the description of the terms "one embodiment", "some embodiments", "examples", "concrete examples" or "some examples" means that the specific features, structures, materials or characteristics described in connection with this embodiment or example are included in at least one embodiment or example of the present disclosure. In this specification, the schematic expressions of the above terms do not necessarily refer to the same embodiments or examples. Furthermore, the specific features, structures, materials or characteristics described may be combined in any one or more embodiments or examples in a suitable manner. In addition, those skilled in the art can join and combine different embodiments or examples described in this specification.

While embodiments of the present disclosure have been shown and described above, it is to be understood that the above-described embodiments are exemplary and not to be construed as limiting the disclosure, and that variations, modifications, substitutions, and variations of the above-described embodiments may occur to those skilled in the art within the scope of the present disclosure.

What is claimed is:

1. A speed regulating hand brake mechanism, comprising:

a housing (100), wherein an installation cavity is defined inside the housing (100);

a speed regulating button (200),wherein the speed regulating button (200) is hinged to the side wall of the housing (100);

a driving part (300) wherein the installation cavity is internally provided with the driving part (300) hinged to the speed regulating button (200);

a rack (400), wherein the rack (400) is hinged to the driving part (300) and can slide along the inner wall of the installation cavity in a horizontal direction after receiving the pressing force transmitted from the speed regulating button (200);

an encoder (500), wherein the encoder (500) is fixed on a first fixing plate (104) in the installation cavity, the rack (400) drives a gear (600) arranged at the top of the encoder (500) to rotate, and a code value output by the encoder (500) is changed;

a return piece (700), wherein an elastic end (701) of the return piece (700) is located inside the speed regulating button (200), and the other side of the return piece (700) is fixed on the inner wall of the installation cavity and is used for resetting the speed regulating button (200);

wherein the driving part (300) comprises a fixing base (301), a connecting rod (302) and a connecting base (303);

the fixing base (301) is fixed to the top of the inner side of the speed regulating button (200), and the connecting base (303) is integrally connected to one end of the rack (400):

two ends of the connecting rod (302) are provided with hinge shafts in different directions, and the two ends of the connecting rod (302) are respectively hinged to a first hinge hole on the fixing base (301) and a second hinge hole on the connecting base (303).

2. The mechanism of claim 1, wherein the housing (100) comprises a first housing (101) and a second housing (102) which are mutually buckled in a vertical direction.

3. The mechanism of claim 1, wherein a linear guide rail (103) is fixed on the inner wall of the installation cavity corresponding to the position of the gear (600);

the rack (400) can slide on the linear guide rail (103) through a fixed integral sliding block.

4. The mechanism of claim 1, wherein an inner bottom of the speed regulating button (200) is hinged to the housing (100).

5. The mechanism of claim 1, wherein another end of the return piece (700) is an installation fixed end (702), the installation fixing end (702) is provided with an installation hole, and the installation hole is fixed with the inner wall of the installation cavity by a screw;

the elastic end (701) is bent downward along the installation fixing end (702) and elastically contacts with the inner bottom of the speed regulating button (200).

6. The mechanism of claim 1, further comprising: an exposure key (900), wherein the exposure key comprises an exposure button box (901), a key switch (902) and a return spring (903);

the exposure button box (901) is partially inserted into a through hole provided at the top of the housing (100), and its bottom is fixed in the installation cavity by the second fixing plate (105);

the inside of the exposure button box (901) is provided with the key switch (902), and a wire of the key switch (902) extends downward to join the wire of the encoder (500) and protrudes from the bottom of the installation cavity;

the return spring (903) is sleeved on the key switch (902).

7. The mechanism of claim , wherein the bottom of the housing, (100) is connected with a base (800) for fixing.

8. A method for speed regulation of a speed regulating hand brake, comprising:

pushing a driving part by the speed regulating button, pushing a rack to drive a top gear of the encoder to rotate to change a code value of the encoder, and controlling an external servo motor driver to rotate at different speeds according to different code values of an encoder to realize speed regulation by an external control system;

wherein the speed regulating hand brake comprises a housing (100), wherein an installation cavity is defined inside the housing (100);

a speed regulating button (200), wherein the speed regulating button (200) is hinged to the side wall of the housing (100);

a driving part (300), wherein the installation cavity is internally provided with the driving part (300) hinged to the speed regulating button (200);

a rack (400), wherein the rack (400) is hinged to the driving part (300) and can slide along the inner wall of the installation cavity in a horizontal direction after receiving the pressing force transmitted from the speed regulating button (200);

an encoder (500), wherein the encoder (500) is fixed on a first fixing plate (104) in the installation cavity, the rack (400)) drives a gear (600) arranged at the top of the encoder (500) to rotate, and a code value output by the encoder (500) is changed;

a return piece (700), wherein an elastic end (701) of the return piece (700) is located inside the speed regulating button (200), and the other side of the return piece (700) is fixed on the inner wall of the installation cavity and is used for resetting the speed regulating button (200);

wherein the driving part (300) comprises a fixing base (301), a connecting rod (302) and a connecting base (303);

the fixing base (301) is fixed to the top of the inner side of the speed regulating button (200), and the connecting base (303) is integrally connected to one end of the rack (400);

two ends of the connecting rod (302) are provided with hinge shafts in different directions, and the two ends of the connecting rod (302) are respectively hinged to a first hinge hole on the fixing base (301) and a second hinge hole on the connecting base (303).

* * * * *